US005309583A

United States Patent [19]

White et al.

[11] Patent Number: 5,309,583

[45] Date of Patent: May 10, 1994

[54] POWERED LIFT TOILET SEAT

[76] Inventors: Johnny White, 411 Main, Newport, Ark. 72112; Greg Dolling, 28 Westgate, Searcy, Ark. 72143; Paul Carter, Rte. 2, Box 608, Cave City, Ark. 72521; Edward L. House, 1305 Briar Dr., Batesville, Ark. 72501

[21] Appl. No.: 74,395

[22] Filed: Jun. 10, 1993

[51] Int. Cl.[5] ..... A47K 13/10

[52] U.S. Cl. ..... 4/667; 4/246.1; 4/246.4; 297/DIG. 10

[58] Field of Search ..... 4/254, 480, 246.1, 246.3, 4/246.4, 246.5, 667; 297/DIG. 10

[56] References Cited

U.S. PATENT DOCUMENTS

| | | | |
|---|---|---|---|
| 1,399,744 | 12/1921 | Brophy | 4/254 |
| 2,869,623 | 1/1959 | Poulin | 297/DIG. 10 |
| 3,473,174 | 10/1969 | Cool | 4/254 |
| 3,925,833 | 12/1975 | Hunter | 4/251 |
| 4,185,335 | 1/1980 | Alvis | 4/251 |
| 4,581,778 | 4/1986 | Pontoppidan | 4/251 |
| 4,587,678 | 5/1986 | Love et al. | 4/251 |
| 4,833,736 | 5/1989 | Sadler et al. | 4/254 |
| 4,884,841 | 12/1989 | Holley | 4/254 |
| 4,907,303 | 3/1990 | Baird | 4/480 |
| 4,949,408 | 9/1990 | Trkla | 5/86 |
| 4,993,084 | 2/1991 | Gibbons | 4/251 |
| 5,142,709 | 9/1992 | McGuire | 4/667 |
| 5,155,873 | 10/1992 | Bridges | 4/667 |
| 5,189,739 | 3/1993 | Thierry | 4/254 |

FOREIGN PATENT DOCUMENTS

| | | | |
|---|---|---|---|
| 1554583 | 4/1970 | Fed. Rep. of Germany | 4/246.1 |
| 2625046 | 12/1977 | Fed. Rep. of Germany | 297/DIG. 10 |

*Primary Examiner*—Henry J. Recla
*Assistant Examiner*—Charles R. Eloshway
*Attorney, Agent, or Firm*—Ray F. Cox, Jr.

[57] ABSTRACT

A powered toilet seat used in association with a toilet bowl or throw-away waste receptacle and which may be used to assist a person in being raised and lowered relative to the toilet bowl. The present invention provides separate sets of mechanical linkages in order to provide the optimum motion for raising and lowering of the seat and for raising and lowering of the armrest. While the seat is constrained to both lift and move forward slightly while it is being rotated forwardly, the armrests follow a circular arc in which the armrests initially move predominately in the upward direction and complete the motion by moving predominately in a forward direction. In addition, the armrests are maintained in a horizontal orientation at all time.

2 Claims, 5 Drawing Sheets

POWERED LIFT TOILET SEAT

BACKGROUND OF THE INVENTION

This invention relates to a powered toilet seat used in association with a toilet bowl and which may be used to assist a person in being raised and lowered relative to the toilet bowl.

The concept of a powered lift toilet seat has been disclosed in a number of variant designs. For example, U.S. Pat. No. 4,587,678 issued to Love, et al. on May 13, 1986 for "Toilet Seat Booster" discloses a stationary frame with fixed handrails. A seat assembly is pivotally coupled to the stationary frame and a ball screw motor and lift arm are provided for pivotally moving the seat frame assembly relative to the stationary frame. While most toilet lift seats incorporate some form of pivoting seat assembly, U.S. Pat. No. 3,925,833 issued to Hunter on Dec. 16, 1977 for "Portable Electric Hydraulic Johnny Aid" discloses a vertically movable toilet seat. Hunter employs an hydraulic cylinder for raising and lowering the seat as opposed to the electric motor of Love.

Another version of an electrically operated toilet seat is disclosed in U.S. Pat. No. 5,155,873 issued to Bridges on Oct. 20, 1992 for "Electrically Operated Lift Stool." Bridges discloses armrests which may be swung out of the way to enable an attendant to assist a disabled person in using the device. Another form of hydraulically powered lift seat is disclosed in U S. Pat. No. 4,993,085 issued to Gibbons on Feb. 19, 1991 for "Power Assisted Toilet Seat." Gibbons discloses a pair of hydraulically operated lift assemblies with associated armrests which are tilted so as to cause the armrests to move in an upward and forward position as the mechanism is operated. The seat is provided with a second pair of hydraulically operated lifts in order to tilt the seat up and forward as the lift assemblies are operated.

The mechanical linkages allowing a powered lift seat to tilt while moving upward and forward is the subject of the disclosure of U.S. Pat. No. 4,581,778 issued to Pontoppidan on Apr. 15, 1986 for "Mechanism for Raising and Lowering a Seat Especially Designed for Handicapped Persons." Pontoppidan discloses a mechanism comprising two supporting arms which are both at one of their ends coupled to the seat and cooperate at their other end with a fixed point and driving member to provide the correct motion.

SUMMARY OF THE INVENTION

In order to function effectively and safely for its intended purpose, a powered lift toilet seat should provide stable and secure support for the patient and should further mimic, to the extent possible, the natural motion of the human body in raising itself from and lowering itself to a seated position. The prior art powered lift toilet seats have concentrated on providing the proper motion of the toilet seat. Of at least equal importance, however, is to provide the support of armrests and to assure that the motion of the armrests relative to the seat allow for proper balance of the patient and adequate assistance in rising from or lowering to a seated position. The optimum motion for the seat and for the armrests are necessarily somewhat different. The prior art, however, gives little recognition to the problem of providing the necessary optimum motion for the armrests as opposed to the motion of the seat. In much of the prior art, the armrests are rigidly affixed to the seat and precisely duplicate the motion of the seat. Often the armrests are caused to tilt with the same motion as the seat. The optimum motion for the seat is to provide for the seat to both lift and move forward slightly while it is being rotated into approximately a 45° angle. By contrast, the optimum motion for the armrests is to follow a circular arc in which the armrests initially move predominately in the upward direction and complete the motion by moving predominately in a forward direction. In addition, the armrests should at all times be kept horizontal for assuring a firm grip and balance on the part of the patient.

It is accordingly an object of the present invention to provide for a powered lift toilet seat in which the armrests and seat are each provided with their distinctive optimum motion.

It is a further object of the present invention to provide for a powered lift toilet seat in which the toilet seat is tilted upon being raised or lowered while the armrests are maintained in a horizontal orientation.

Other objects and advantages of the present invention will subsequently become apparent from the detailed description of the preferred embodiment and appended claims with reference to the accompanying drawings.

DETAILED DESCRIPTION OF THE PREFERRED EMBODIMENTS

Figure 1:
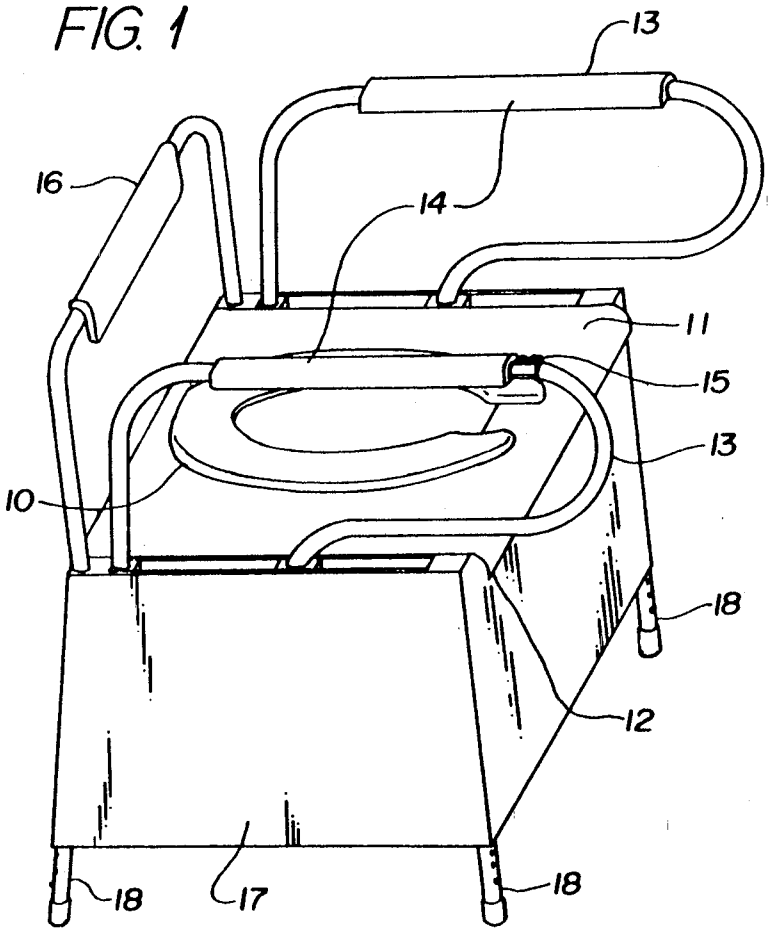
FIG. 1 is a perspective view of the right side of the present invention.

The major components of the present invention may be described with reference to FIG. 1. On the top of the unit is a standard type of toilet seat 10. The toilet seat 10 rests on a shield 11 which covers the entire top of the unit. The shield 11 has a rolled over front edge 12 as a safety precaution to avoid any possibility of pinching the user as the seat 10 is raised or lowered. Armrests 13 are disposed to either side of the unit. A padded cover 14 may be provided. In addition, in the preferred embodiment of the present invention a rocker switch 15 is located on one of the armrests 13. The rocker switch 15 is used to operate the raising and lowering action of the present invention. The necessary Wiring for the rocker switch 15 may be led through the armrests 13 which are constructed of hollow tubing into the interior of the unit for connection to the actuating mechanism which will be described below. The unit is equipped with a backrest 16 and a shroud assembly 17. The shroud assembly 17 covers the front and sides of the unit and, in addition, may incorporate internal partitions to shield the working mechanism. The back of the unit, however, is left open to assist in placing the unit in position over a toilet bowl as described more fully below.

The unit is also equipped with adjustable legs 18. In an alternative embodiment, some or all of the adjustable legs 18 may be replaced by wheels.

Figure 2:
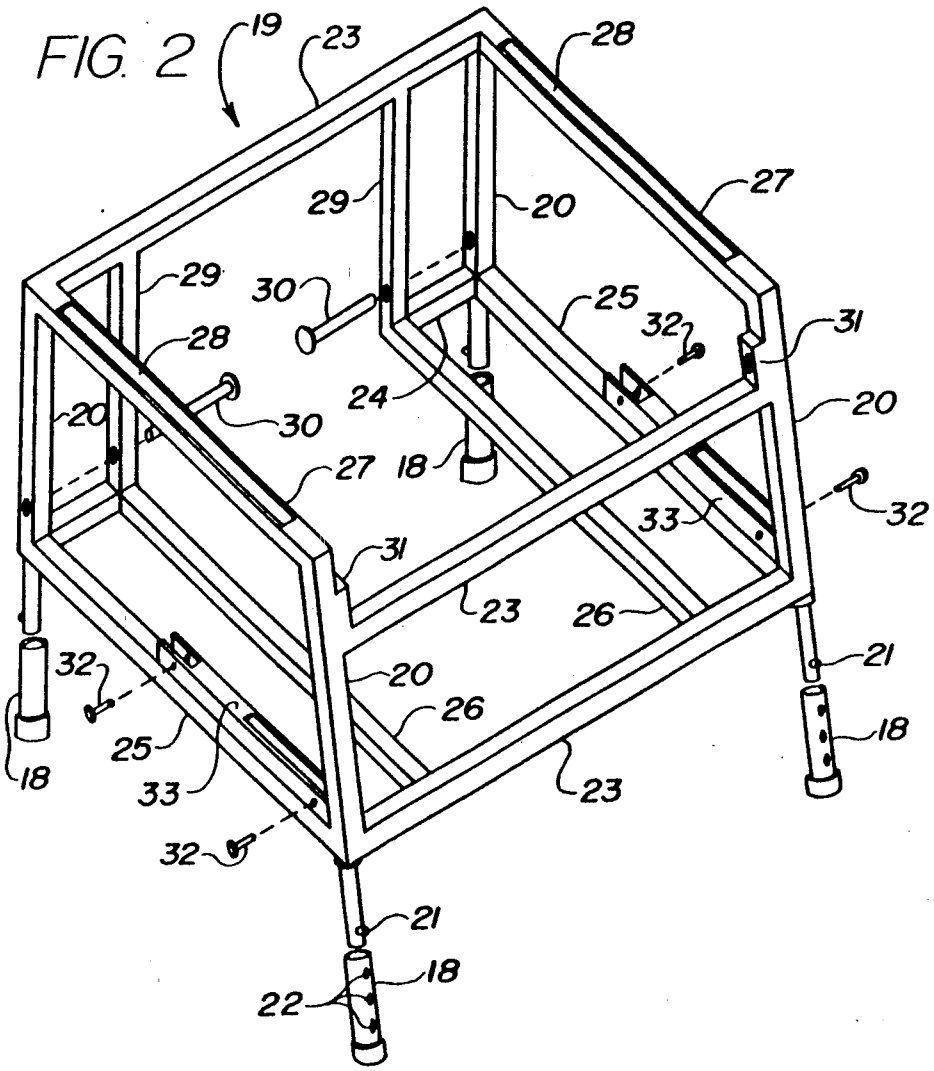
FIG. 2 is a partially exploded perspective view of the support assembly.

The entire unit is built around a support assembly 19 which is shown in partially exploded fashion in FIG. 2. The support assembly 19 comprises a framework to which the various components of the invention may be attached. An upright member 20 at each corner provides support for the adjustable legs 18. The adjustable legs 18 are constructed essentially in the same manner as adjustable crutch tips which are well known in the art. On each adjustable leg 18 a pin 21 may be employed in a plurality of receiving holes 22 so that the height of the unit may be adjusted in discrete increments. This method of adjustment also allows for the unit to be adjusted so that the front is either higher or lower than the rear of the unit. The height adjustment is also necessary to allow for varying toilet heights as well as to adjust the height of the unit for the greatest comfort of various sized users. As indicated above, some or all of the adjustable legs 18 may be removed and replaced by wheels for improving the portability of the unit.

The support assembly 19 is provided with a plurality of transverse braces 23. The placement of the transverse braces 23 is not critical so long as sufficient rigidity of the entire structure is attained. Typically transverse braces 23 would be found at the upper front edge, upper back edge and lower front edge of the unit. Shortened transverse braces 24 are required at the back of the unit in order to allow the unit to be placed over a toilet bowl.

The unit is further equipped with lower external longitudinal braces 25 and lower internal longitudinal braces 26. Upper longitudinal transverse braces 27 are provided with longitudinal channels 28 whose function will be described in more detail below. Finally, internal upright members 29 are provided at the back of the unit connecting the internal longitudinal braces 26 with the shortened transverse braces 24 and the upper rear transverse brace 23.

The support assembly 19 provides attachment points for the shroud assembly 17. Furthermore, the backrest 16 is rigidly affixed to the support assembly 19. In addition, four critical pivot points are located on each side of the support assembly 19. The first pivot point is a pin 30 which passes between the rear upright members 20 and 29 at their lower ends just above the shortened transverse brace 24.

The second critical set of pivot points are represented by pivot blocks 31 on the upper interior sides of the front upright members 20 just above the transverse brace 23. The remaining two pivot points are represented by pins 32 which are contained in brackets 33 located on lower longitudinal braces 25.

Figure 3:
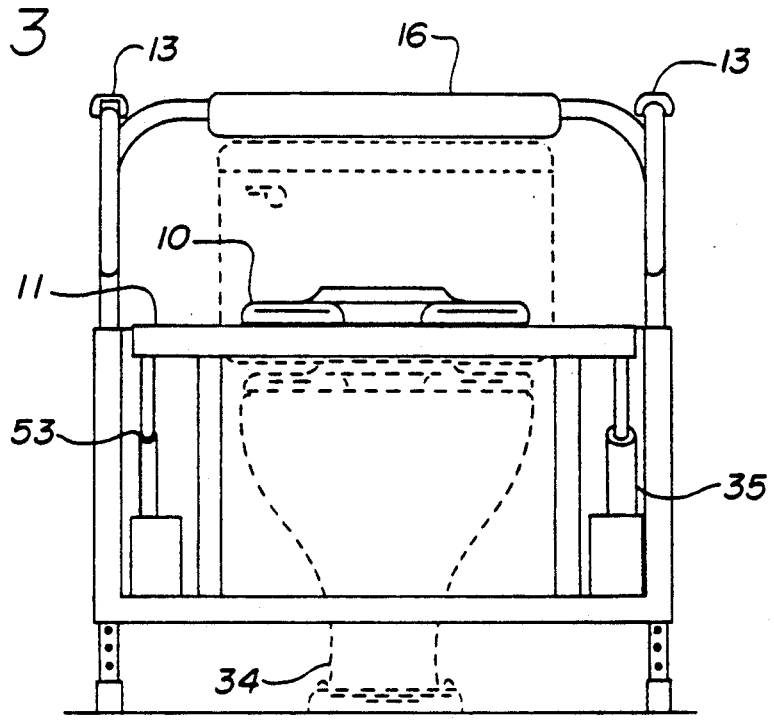
FIG. 3 is a front elevation of the present invention in position over a standard toilet bowl.
Figure 4:
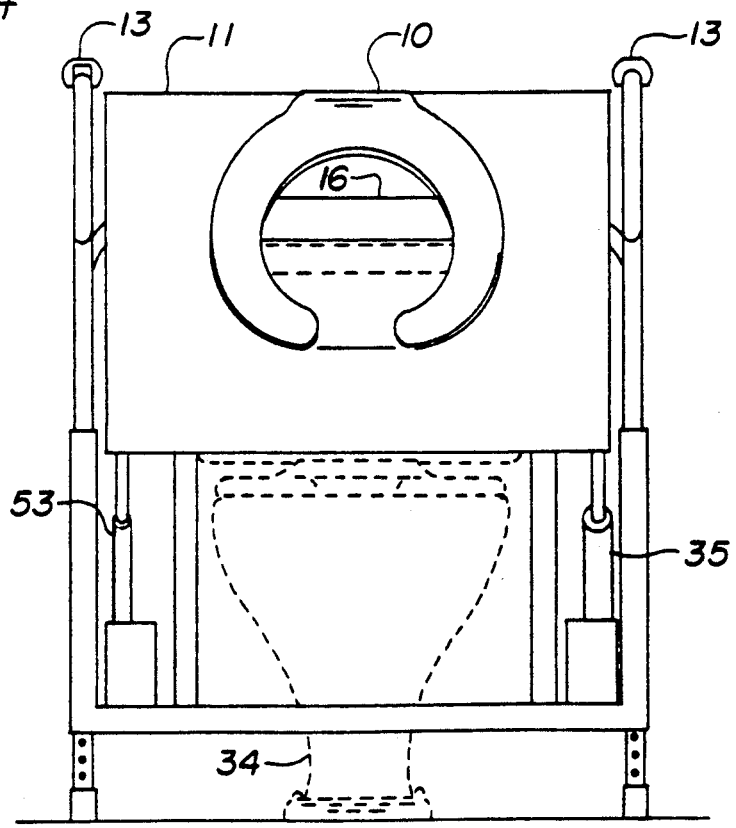
FIG. 4 is a front elevation of the present invention with the seat in the raised position.
Figure 5:
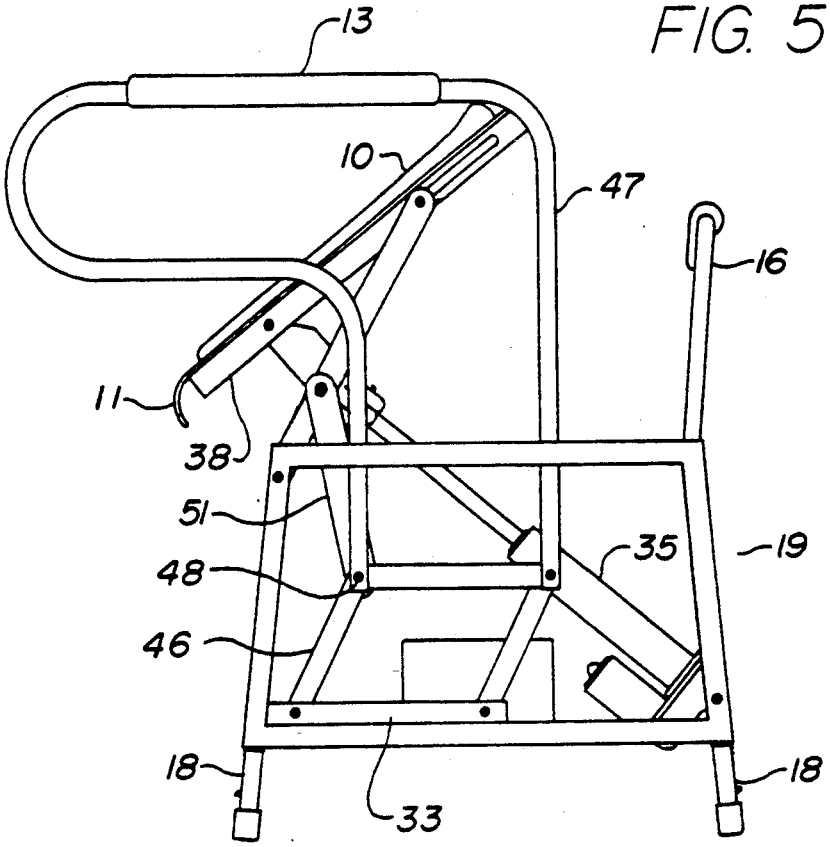
FIG. 5 is an elevation of the left side of the present invention with the shroud assembly removed. The seat is shown in the raised position.

In use the present invention is placed in position surrounding a toilet bowl 34. The unit is placed such that the seat 10 is positioned immediately above the toilet bowl 34. The present invention is shown on FIG. 3 in the lowered position as the unit would appear ready for use. The present invention is shown in FIG. 4 with the seat in the raised position as it would be immediately prior to receiving a patient or as it would appear after the patient has been raised from the seated position after use. The present invention may also be used in an alternative embodiment by employing throw-away waste containers without employing a toilet. The waste container would be hung below the seat 10 and would then be disposed of after use. A typical type of waste container suitable for use with the present invention would be the Care Mate waste container made by Guardian. The mechanical linkages which accomplish the raising of the toilet seat 10 and movement of the armrests 13 are shown in FIG. 5. However, in order to explain the separate sets of mechanical linkages which serve to raise the seat 10 versus the mechanical linkages which provide the motion of the armrests 13, the two will first be discussed separately.

Figure 6:
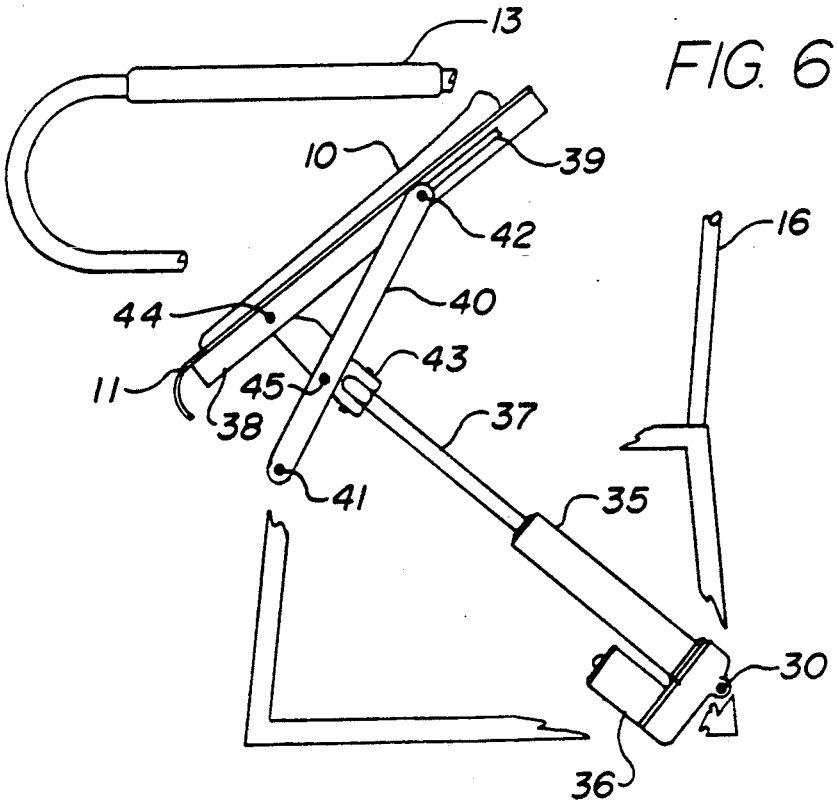
FIG. 6 is a partial left side elevation of the present invention showing the mechanical linkages employed in raising the seat.
Figure 7:
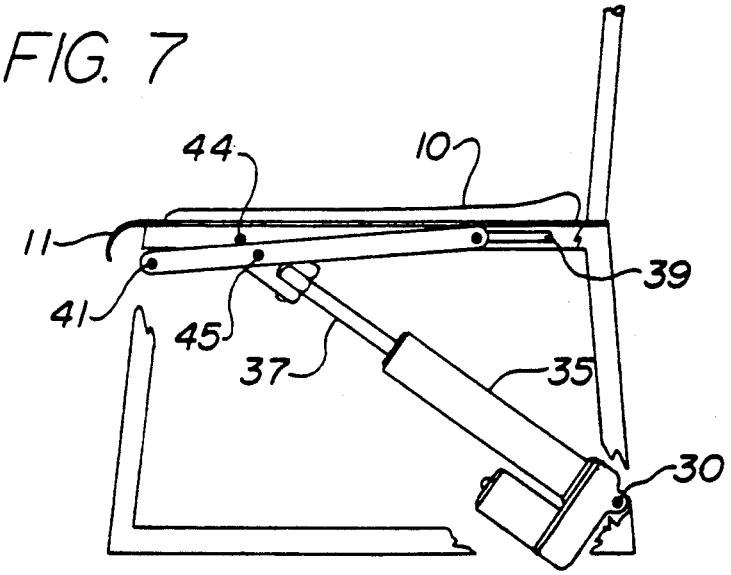
FIG. 7 is a partial left side elevation showing the seat in the lowered position.

The raising and lowering of the seat 10 may be described with reference to FIGS. 6 and 7. A linear actuator 35 is pivotally mounted to the support assembly 19 by the pin 30. The linear actuator 35 may be any of a number of standard types. However, the Model 10 Series D12-20B5-08 linear actuator manufactured by Warner Electric has been found to be effective in the present invention. This particular model contains an internal clutch for limiting travel of the mechanism. The linear actuator 35 includes a drive member 37. The toilet seat 10 is mounted on the shield 11. The shield 11 in turn is supported and braced by seat supports 38, one to each side. The seat supports 38 are provided with longitudinal slots 39 disposed toward the rear of the seat support 38. Support arms 40 are pivotally fixed at one end by pins 41 in pivot blocks 31 on the support assembly 19 and at the other end the support arms 40 are provided with pins 42 which ride in the longitudinal slots 39 and allow both pivotal and longitudinal sliding motion. The drive member 37 of the linear actuator 35 is rigidly affixed to a yoke 43. The yoke 43 is pivotally connected to the seat support 38 at a pin 44 disposed toward the front of the seat support 38. Finally, the yoke 43 is pivotally connected to the support arm 40 at an intermediate point by a pin 45.

In operation, then, the entire assembly acts off of two fixed pivot points, the pins 30 and 41. With reference to FIG. 7, the seat is shown in the retracted or lowered position. As the drive member 37 is extended, support arm 40 is rotated counter-clockwise about pin 41. Simultaneously the combination of drive member 37 and yoke 43 rotate clockwise about pin 45. The yoke 43 through pin 44 pushes the seat support 38 backwards along longitudinal slot 39. The seat support 38 then pivots clockwise about pin 42. The net effect of the various motions, as may be seen with reference to FIG. 6, is to cause the seat 10 to be both raised and rotated in the counter-clockwise direction. Reversing the direction of the linear actuator 35 reverses the sequence of events resulting in returning the seat 10 to the lowered or retracted position. The action of the mechanism is controlled by the user through the rocker switch 15 which is electrically connected to the linear actuator 35. Alternatively, a switch may be attached by a remote cable to the linear actuator 35 so that the raising and lowering of the mechanism may be accomplished by an attendant rather than the patient. Although not shown on the drawings, the linear actuator 35 requires a source of electric power for its operation. The precise form in which the electric power is supplied is not critical to the present invention and any of a number of alternatives well known in the art could be applied. For example, if the linear actuator is of a 12-volt direct current type, a 12-volt gelcel type battery has been found to provide adequate service. The use of a battery renders the unit completely portable. A charging system may be used to maintain the charge on the battery while the unit is not in use. Another well known alternative would be to provide a source of alternating current directly to the linear actuator 35 or indirectly through means of a voltage convertor.

Figure 8:
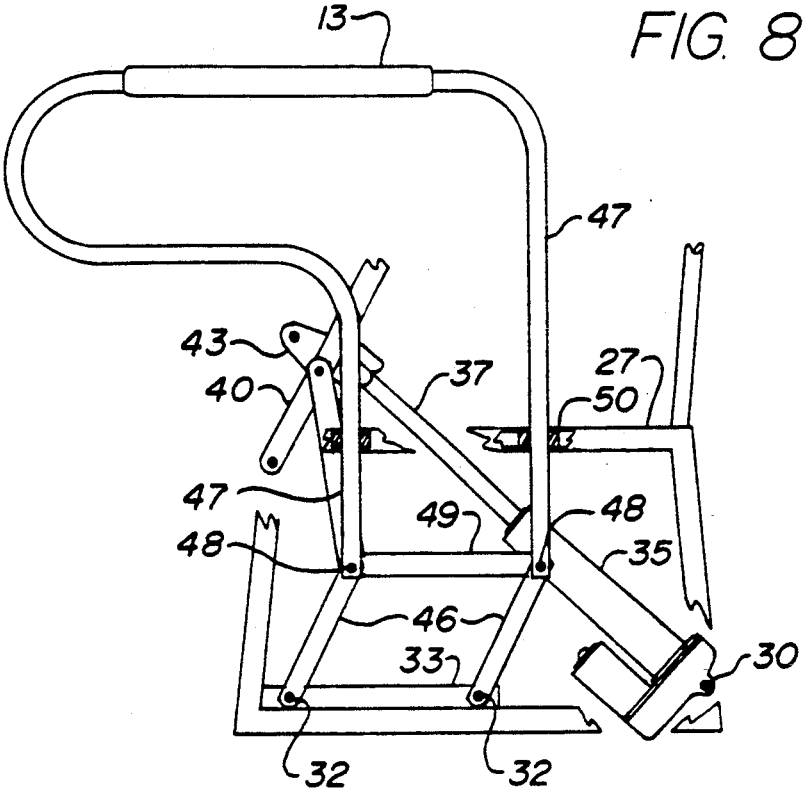
FIG. 8 is a partial left side elevation showing the mechanical linkages involved in the armrests.
Figure 9:
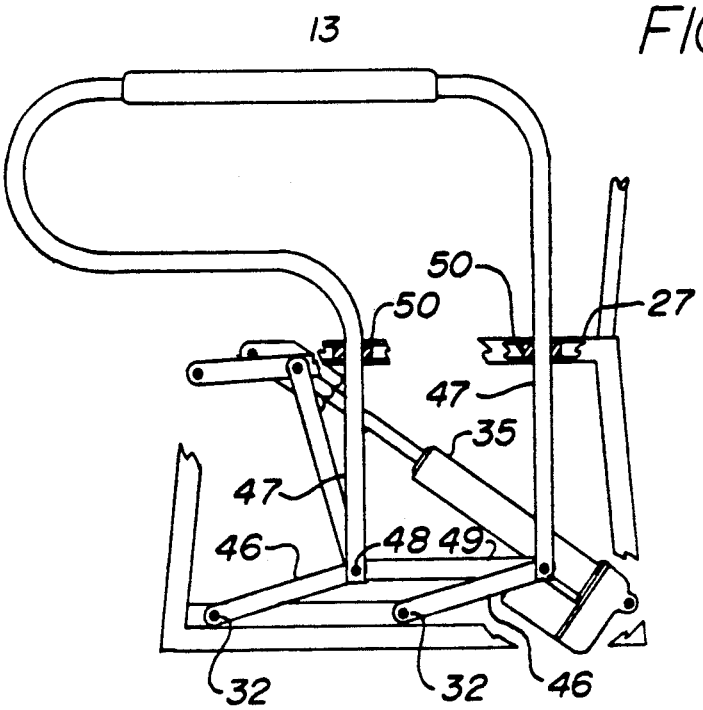
FIG. 9 is a partial left side elevation showing the armrests in the lowered position.

The mechanism to effect the raising and lowering of the armrests 13 is described with reference to FIGS. 8 and 9. A pair of parallel arms 46 are pivotally coupled by pins 32 to brackets 33. The armrest 13 has a pair of depending vertical members 47 which are pivotally coupled to the upper ends of the parallel arms 46 by pins 48. A spacing member 49 is provided between the pins 48 in order to increase the rigidity of the mechanism. The spacing of the parallel arms 46 is such as to ensure a parallel relationship at all stages of movement of the mechanism.

The armrests 13 are also stabilized and given greater rigidity at all phases of movement by the provision of sliding blocks 50 which are disposed within the channel 28 on the top of the support assembly 19 as described previously. The blocks 50 are free to slide longitudinally along the channel 28. In addition, the depending members 47 of the armrests 13 are slidably received within the blocks 50 so that the armrests 13 are supported while remaining free to move both vertically and longitudinally.

A coupling member 51 is connected between intermediate point 45 and one of the coupling pins 48, preferably in the preferred embodiment the forward most pin 48. The linear actuator 35 acts to raise the armrests 13 by extending the driving member 37 which applies an outward force on the coupling member 51. As a result, the parallel arms 46 are caused to rotate counter-clockwise in an arc about the pins 32. Beginning from the retracted position as shown on FIG. 9, the motion of the parallel arms 46 is initially primarily in a vertical direction causing the depending members 47 of the armrests 13 to move upward through the blocks 50. As the motion continues as exemplified in FIG. 8, the motion of the parallel arms 46 becomes more nearly horizontal. The armrest 13 begins to slide forward supported by the longitudinal sliding motion of the blocks 50. It is thus seen that the armrest 13 follows an arcuate path which is essentially a quarter circle. Reversing the action of the linear actuator 35 reverses the sequence of described motions.

It may be seen that through the action of the connecting member 51 the two separate sets of linkages which control the motion of the seat 10 and the armrests 13 are directed by a single linear actuator 35.

In the preferred embodiment, a single linear actuator 35 is employed to control the motion of the seat 10 and the armrest 13. Referring to FIGS. 3 and 4, it may be seen that a second linear actuator 52 and associated duplicate sets of mechanical linkages could be employed if desired. As an alternative arrangement, a single linear actuator 35 may be employed in conjunction with a slide arrangement 53 to mimic the action of the drive member 37 in relation to the linear actuator 35. Thus, both sides of the unit may be equally supported and braced for rigid and stable movement.

The present invention has been described with reference to certain preferred embodiments which are given by way of example and not of limitation to the full scope of the present invention as set forth in the appended claims.

What is claimed is:

1. A powered lift toilet seat, comprising:

a toilet seat having a frontward portion, a rearward portion and a pair of toilet seat support sides;

a support assembly for supporting said toilet seat over a toilet bowl positioned on a floor, said support assembly comprising a pair of support assembly sides braced by a plurality of transverse braces, each of said support assembly sides having a front member, a lower member, an upper member and a rear member;

means for moving said toilet seat between a first position horizontally disposed above the toilet bowl and a second position elevated and tilted forward relative to the toilet bowl, said means for moving said toilet seat comprising at least one seat-raising linkage associated with one of said support assembly sides comprising a longitudinal slot in a respective one of said toilet seat support sides, a supporting arm having a first end pivotally coupled to a fixed point in said front member of said support assembly side and a second end having a bearing pin disposed in said longitudinal slot for both pivotal and longitudinal sliding motion of said supporting arm relative to said toilet seat, a reversible electrically powered linear actuator pivotally coupled at a fixed rearward point in said rear member of said support assembly side and having a driving member, said driving member having an end pivotally coupled to a point in said frontward portion of said toilet seat, and means for pivotally coupling said drive member to said supporting arm at an intermediate point intermediate to said first and second ends of said supporting arm and intermediate to said end of said drive member and said fixed rearward point of said rear member;

a pair of armrests pivotally connected to said support assembly; and means for moving said armrests along an arcuate path between a position corresponding to said first position wherein said armrests are disposed substantially above said toilet seat to a position corresponding to said second position wherein said armrests are disposed relatively higher and forward of said position corresponding to said first position and simultaneously maintaining said armrests parallel to the floor.

2. A powered lift toilet seat as set forth in claim 1, wherein each of said armrests comprises a substantially horizontal member and a pair of vertical members rigidly affixed thereto and depending therefrom, and each of said vertical members having lower ends, and further, wherein said means for moving said armrests comprises a longitudinal channel along each of said upper members of said support assembly sides;

a pair of blocks slidably coupled to each of said channels and slidably receiving said vertical members;

a pair of parallel arms, each having first ends and second ends, each of said second ends of said parallel arms being pivotally coupled to respective said lower ends of said vertical members and each of said first ends of said parallel arms being pivotally coupled to respective said lower member of said support assembly side in such a spaced relationship that said parallel arms are parallel throughout movement of said armrests along said arcuate path; and a connecting member having first and second ends, said first end of said connecting member being pivotally coupled to one of said lower ends of said vertical members and said second end of said connecting member being pivotally coupled to said intermediate point.

* * * * *

UNITED STATES PATENT AND TRADEMARK OFFICE

CERTIFICATE OF CORRECTION

PATENT NO. : 5,309,583

DATED : May 10, 1994

INVENTOR(S) : Johnny White; Greg Dollins; Paul Carter; Edward L. House

It is certified that error appears in the above-identified patent and that said Letters Patent is hereby corrected as shown below:

On the title page, under "Inventors", second line, delete "Dolling" and insert in place thereof --Dollins--.

Signed and Sealed this

Sixteenth Day of March, 1999

*Attest:*

*Attesting Officer*

Q. TODD DICKINSON

*Acting Commissioner of Patents and Trademarks*